US009533847B2

(12) United States Patent
Matsushita et al.

(10) Patent No.: US 9,533,847 B2
(45) **Date of Patent: *Jan. 3, 2017**

(54) PAPER-SHEET FEEDING UNIT

(71) Applicant: GLORY LTD., Himeji-shi, Hyogo-ken (JP)

(72) Inventors: Hidehiko Matsushita, Himeji (JP); Masaaki Fukazawa, Himeji (JP); Fumiaki Koga, Himeji (JP)

(73) Assignee: GLORY LTD., Himeji-shi, Hyogo-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/064,994

(22) Filed: Mar. 9, 2016

(65) Prior Publication Data

US 2016/0229649 A1 Aug. 11, 2016

Related U.S. Application Data

(63) Continuation of application No. 13/912,250, filed on Jun. 7, 2013, now Pat. No. 9,340,381.

(30) Foreign Application Priority Data

Jun. 8, 2012 (JP) ..... 2012-130971

(51) Int. Cl.
*B65H 3/46* (2006.01)
*B65H 3/52* (2006.01)
(Continued)

(52) U.S. Cl.
CPC ..... *B65H 3/5276* (2013.01); *B65H 3/063* (2013.01); *B65H 3/0638* (2013.01); *B65H 3/523* (2013.01);
(Continued)

(58) Field of Classification Search
CPC ..... B65H 5/068; B65H 3/063; B65H 3/523; B65H 2404/1141; B65H 2404/5311
(Continued)

(56) References Cited

U.S. PATENT DOCUMENTS 4,653,742 A * 3/1987 Sasaki ..... B65H 3/063 271/114
5,297,786 A * 3/1994 LaChapelle ..... B65H 3/063 271/119
(Continued)

FOREIGN PATENT DOCUMENTS

CN 1714363 A 12/2005
CN 1867950 A 11/2006
(Continued)

OTHER PUBLICATIONS

"Bill Singling Mechanism", IBM Technical Disclosure Bulletin (vol. 32, No. 1, Jun. 1989), IBM Corp. (2 pages).*
(Continued)

*Primary Examiner* — Jeremy R Severson
(74) *Attorney, Agent, or Firm* — Renner, Kenner, Greive, Bobak, Taylor & Weber

(57) ABSTRACT

A paper-sheet feeding unit includes: a feed roller configured to be rotated when feeding out a paper sheet, the feed roller having a high friction portion placed on a part of a circumference of an outer circumferential surface thereof, and a low friction portion placed on a location of the outer circumferential surface thereof other than the high friction portion, the low friction portion having a frictional coefficient smaller than that of the high friction portion; and a gate member arranged to be pressed against the outer circumferential surface of the feed roller, the gate member constituting a gate section configured to separate, one by one, the paper sheets fed out by the feed roller.

10 Claims, 8 Drawing Sheets

(51) Int. Cl.
*B65H 3/06* (2006.01)
*B65H 5/06* (2006.01)

(52) U.S. Cl.
CPC ..... *B65H 5/068* (2013.01); *B65H 2402/61* (2013.01); *B65H 2404/111* (2013.01); *B65H 2404/1141* (2013.01); *B65H 2404/5311* (2013.01); *B65H 2601/324* (2013.01); *B65H 2701/1912* (2013.01)

(58) Field of Classification Search
USPC ..... 271/119, 120, 3.05, 23, 165, 122
See application file for complete search history.

(56) References Cited

U.S. PATENT DOCUMENTS

| | | | | |
|---|---|---|---|---|
| 6,186,490 | B1 * | 2/2001 | Sugiura | B65H 3/0638 271/10.09 |
| 7,140,607 | B2 * | 11/2006 | Graef | B65H 3/5246 271/110 |
| 7,611,140 | B2 * | 11/2009 | Graef | B65H 3/5246 271/121 |
| 8,511,672 | B2 * | 8/2013 | Kubo | B65H 3/0638 271/119 |
| 9,340,381 | B2 * | 5/2016 | Matsushita | B65H 5/068 |
| 2002/0085245 | A1 * | 7/2002 | Mennie | B65H 3/063 358/498 |
| 2004/0080094 | A1 * | 4/2004 | Dopfer | B65H 3/5284 271/122 |
| 2004/0178558 | A1 * | 9/2004 | Graef | B65H 3/06 271/109 |
| 2011/0304091 | A1 * | 12/2011 | Hirano | G06M 7/06 271/3.14 |
| 2013/0328260 | A1 * | 12/2013 | Matsushita | B65H 5/068 271/109 |
| 2015/0187159 | A1 * | 7/2015 | Yin | B65H 3/063 271/10.09 |
| 2015/0360890 | A1 * | 12/2015 | Hwang | B65H 3/0684 271/10.01 |

FOREIGN PATENT DOCUMENTS

| | | | |
|---|---|---|---|
| CN | 1990365 | A | 7/2007 |
| CN | 1839081 | B | 9/2010 |
| CN | 102205913 | A | 10/2011 |
| JP | 4-129935 | A | 4/1992 |
| JP | 6-301646 | A | 11/1993 |
| JP | 9-58879 | A | 3/1997 |
| JP | 11-208907 | A | 8/1999 |
| JP | 2010-173810 | A | 8/2010 |
| JP | 2012-66902 | A | 4/2012 |

OTHER PUBLICATIONS

Japanese Office Action with English translation (Japanese Patent Application No. 2012-130971) (7 pages—dated May 27, 2016).
Chinese Office Action with English translation (Application No. 201310227288.1) (22 pages dated Feb. 15, 2016.

* cited by examiner

PAPER-SHEET FEEDING UNIT

CROSS REFERENCE TO RELATED APPLICATIONS

This application is a continuation of U.S. patent application Ser. No. 13/912,250 filed on Jun. 7, 2013, which is incorporated herein by reference, which was based upon and claims the benefit of priority from the prior Japanese Patent Application No. 2012-130971 filed on Jun. 8, 2012, the entire contents of which are incorporated herein by reference.

TECHNICAL FIELD

The present invention relates to a paper-sheet feeding unit configured to sequentially feed outside, one by one, a plurality of paper sheets stored in a paper-sheet storing unit or the like.

BACKGROUND ART

A paper-sheet feeding unit used in a banknote counter or the like is configured to sequentially feed out, one by one, paper sheets (such as banknotes) in a stacked state, so as to carry the paper sheets outside.

A structure of a conventional paper-sheet feeding unit is described with reference to FIGS. 14(A), 14(B), 15(A) and 15(B). A paper-sheet feeding unit 80 as shown in FIGS. 14(A) and 14(B) include a feed roller 82, a gate roller 84 and a kicker roller 86. In such a paper-sheet feeding unit 80, a lowermost paper sheet P among a plurality of paper sheets P in a stacked state is kicked by the kicker roller 86 in the right direction in FIGS. 14(A) and 14(B), and the kicked paper sheets P are fed out, one by one, by a gate section 83 formed between the feed roller 82 and the gate roller 84. In the paper-sheet feeding unit 80 as shown in FIGS. 14(A) and 14(B), a gap is provided between the feed roller 82 and the gate roller 84. The gap corresponds to a thickness of one paper sheet P. The feed roller 82 is configured to be rotated clockwise in FIGS. 14(A) and 14(B) about a shaft 82*a*. A rubber member 82*b* is placed on a part of a circumference of an outer circumferential surface of the feed roller 82. On the other hand, the gate roller 84 is configured to be rotated clockwise in FIGS. 14(A) and 14(B) about a shaft 84*a*. A rubber member 84*b* is placed all around an outer circumferential surface of the gate roller 84. The kicker roller 86 is configured to be rotated clockwise in FIGS. 14(A) and 14(B) about a shaft 86*a*. A rubber member 86*b* is placed on a part of a circumference of an outer circumferential surface of the kicker roller 86. The paper-sheet feeding unit 80 having the gap between the feed roller 82 and the gate roller 84, as shown in FIGS. 14(A) and 14(B), is disclosed in JP3703598B and JP4680302B, for example.

However, when the paper-sheet feeding unit 80 as shown in FIGS. 14(A) and 14(B) feed out plural kinds of paper sheets P having different thicknesses and/or stiffnesses, there occurs a problem that the paper sheets P cannot be properly fed out, because of the gap between the feed roller 82 and the gate roller 84. Thus, the single paper-sheet feeding unit 80 cannot deal with banknotes of various countries. Thus, there is conventionally a case in which a paper-sheet feeding unit 90 as shown in FIGS. 15(A) and 15(B) are used.

The paper-sheet feeding unit 90 as shown in FIGS. 15(A) and 15(B) include a feed roller 92, a gate roller 94 and a kicker roller 96. In such a paper-sheet feeding unit 90, a lowermost paper sheet P among a plurality of paper sheets P in a stacked state is kicked by the kicker roller 96 in the right direction in FIGS. 15(A) and 15(B), and the kicked paper sheets P are fed out, one by one, by a gate section 93 formed between the feed roller 92 and the gate roller 94. Differently from the paper-sheet feeding unit 80 as shown in FIGS. 14(A) and 14(B), the gate roller 94 is arranged to be pressed against the feed roller 92. The feed roller 92 is configured to be rotated clockwise in FIGS. 15(A) and 15(B) about a shaft 92*a*. A rubber member 92*b* is placed all around an outer circumferential surface of the feed roller 92. In addition, a rubber member 94*b* is placed all around an outer circumferential surface of the gate roller 94. A torque limiter (not shown) is disposed between the gate roller 94 and the shaft 94*a*. When a force not less than a set torque is applied on the gate roller 94 in the circumferential direction, the torque limiter allows the gate roller 94 to be rotated in a direction in which the paper sheets P are fed out (feeding direction of the paper sheets P) relative to the shaft 94*a*. In addition, the kicker roller 96 is configured to be rotated clockwise in FIGS. 15(A) and 15(B) about a shaft 96*a*. A rubber member 96*b* is placed on a part of a circumference of an outer circumferential surface of the kicker roller 96. The paper-sheet feeding unit 90 in which the rubber member 92*b* is placed all around the outer circumferential surface of the feed roller 92 and the gate roller 94 is arranged to be pressed against the feed roller 92, as shown in FIGS. 15(A) and 15(B), is disclosed in JP4846716A and WO2008/072317, for example.

However, in the paper-sheet feeding unit 90 as shown in FIGS. 15(A) and 15(B), it is necessary to provide the torque limiter on the gate roller 94, and thus there is a problem that such a torque limiter increases a cost and requires an installation space. In addition, in the paper-sheet feeding unit 90 as shown in FIGS. 15(A) and 15(B), it is necessary to overcome the torque limiter provided on the gate roller 94 so as to rotate the feed roller 92, and thus there is a problem that reduction in size of a driving motor and thus the unit as a whole is difficult.

In addition, in the paper-sheet feeding unit 90 as shown in FIGS. 15(A) and 15(B), the rubber member 92*b* is placed all around the outer circumferential surface of the feed roller 92. In this case, after the paper-sheet feeding unit 90 has been used for a long period of time so that the rubber member 92*b* of the feed roller 92 has been worn away, it is impossible to exchange only the rubber member 92*b* such that a base body of the feed roller 92 is left as it is. Thus, there is a problem that the feed roller 92 itself should be detached by moving it in a direction in which the shaft 92*a* extends.

DISCLOSURE OF THE INVENTION

The present invention has been made in view of the above circumstances. The object of the present invention is to provide a paper-sheet feeding unit which is capable of achieving reduction in cost and size, by placing a high friction portion, not all around an outer circumferential surface of a feed roller, but on a part of a circumference thereof, by arranging a gate roller to be pressed against the outer circumferential surface of the feed roller, and by omitting installation of a torque limiter, and which is capable of properly feeding out plural kinds of paper sheets having different thicknesses and/or stiffnesses.

Another object of the present invention is to provide a paper-sheet feeding unit which is capable of facilitating maintenance services on the high friction portion and of reducing maintenance cost, because the high friction portion of the feed roller can be attached to or detached from a base body of the feed roller fixed on a rotational shaft or the rotational shaft itself, in a direction perpendicular to a direction in which the rotational shaft extends.

A paper-sheet feeding unit of the present invention is a paper-sheet feeding unit configured to feed out, one by one, paper sheets in a stacked state, the paper-sheet feeding unit including: a feed roller configured to be rotated when feeding out the paper sheet, the feed roller having a high friction portion placed on a part of a circumference of an outer circumferential surface thereof, and a low friction portion placed on a location of the outer circumferential surface thereof other than the high friction portion, the low friction portion having a frictional coefficient smaller than that of the high friction portion; and a gate member arranged to be pressed against the outer circumferential surface of the feed roller, the gate member constituting a gate section configured to separate, one by one, the paper sheets fed out by the feed roller.

Another paper-sheet feeding unit of the present invention is a paper-sheet feeding unit configured to feed out, one by one, paper sheets in a stacked state, the paper-sheet feeding unit including: a feed roller configured to be rotated when feeding out the paper sheet, the feed roller having a high friction portion placed on a part of a circumference of an outer circumferential surface thereof, and a low friction portion placed on a location of the outer circumferential surface thereof other than the high friction portion, the low friction portion having a frictional coefficient smaller than that of the high friction portion; a gate member disposed opposite to the feed roller, the gate member constituting a gate section configured to separate, one by one, the paper sheets fed out by the feed roller; and a rotational shaft rotatably supporting the feed roller; wherein the high friction portion of the feed roller is attachable to and detachable from a base body of the feed roller fixed on the rotational shaft, in a direction perpendicular to a direction in which the rotational shaft extends.

Still another paper-sheet feeding unit of the present invention is a paper-sheet feeding unit configured to feed out, one by one, paper sheets in a stacked state, the paper-sheet feeding unit including: a feed roller configured to be rotated when feeding out the paper sheet, the feed roller having a high friction portion placed on a part of a circumference of an outer circumferential surface thereof, and a low friction portion placed on a location of the outer circumferential surface thereof other than the high friction portion, the low friction portion having a frictional coefficient smaller than that of the high friction portion; a gate member disposed opposite to the feed roller, the gate member constituting a gate section configured to separate, one by one, the paper sheets fed out by the feed roller; and a rotational shaft rotatably supporting the feed roller; wherein the high friction portion of the feed roller is attachable to and detachable from the rotational shaft in a direction perpendicular to a direction in which the rotational shaft extends.

MODE FOR CARRYING OUT THE INVENTION

Figure 1:
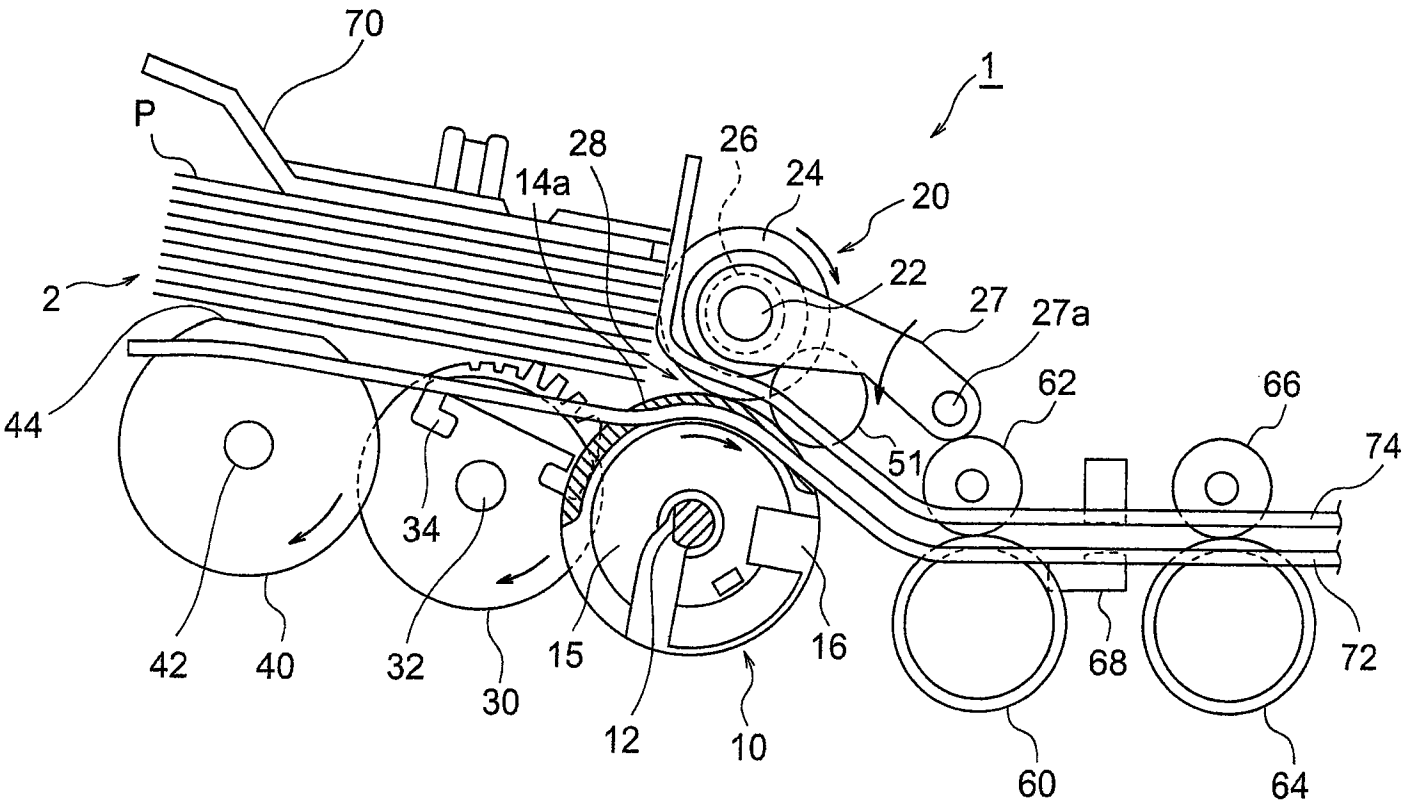
FIG. 1 is a schematic structural view showing a schematic structure of a paper-sheet feeding unit in an embodiment of the present invention.
Figure 2A:
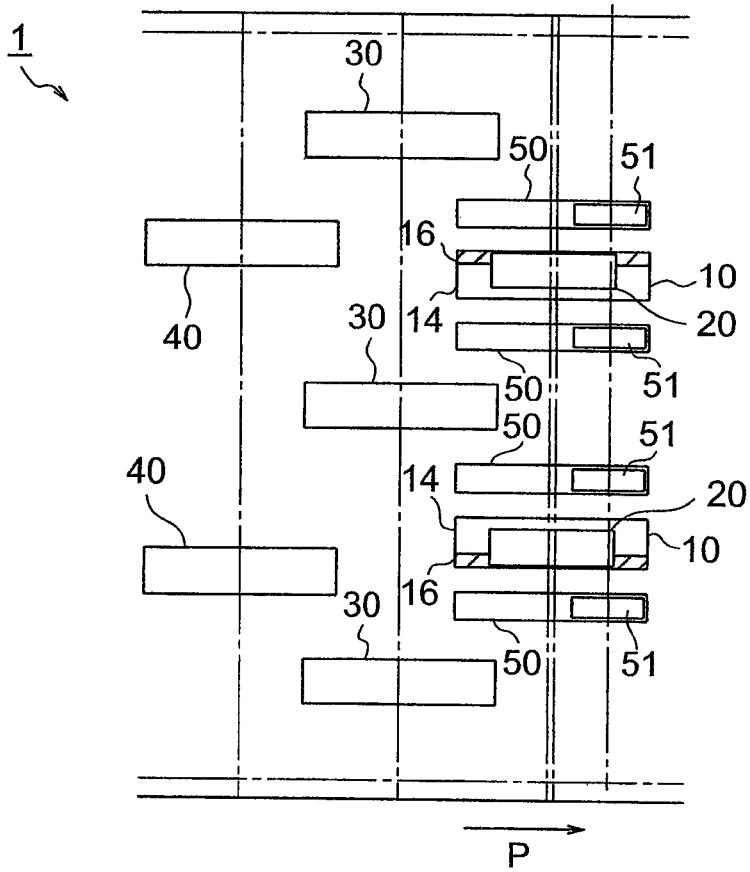
FIG. 2A is a plan view showing a positional relationship among rollers, when the paper-sheet feeding unit shown in FIG. 1 is seen from above.
Figure 2B:
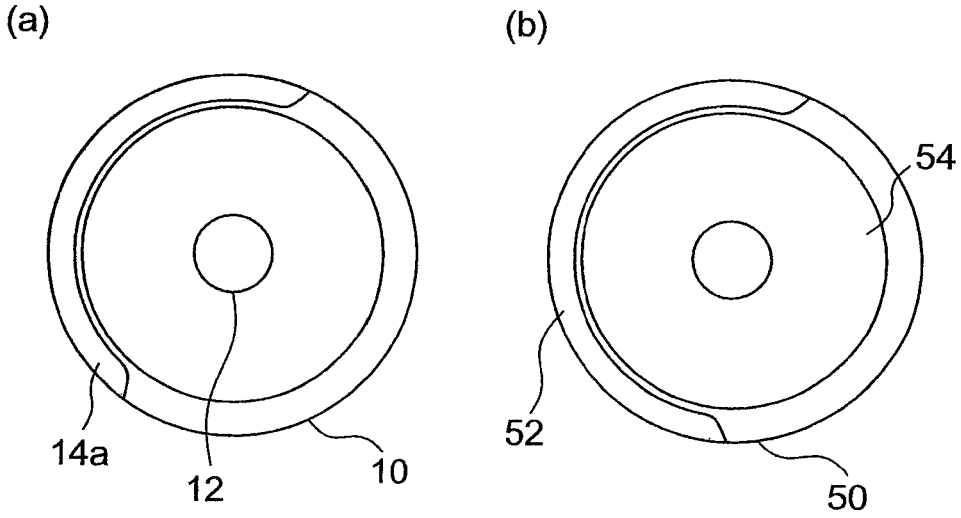
FIG. 2B is a view showing schematic structures of a feed roller and a delivery roller in the paper-sheet feeding unit shown in FIG. 2A.
Figure 3:
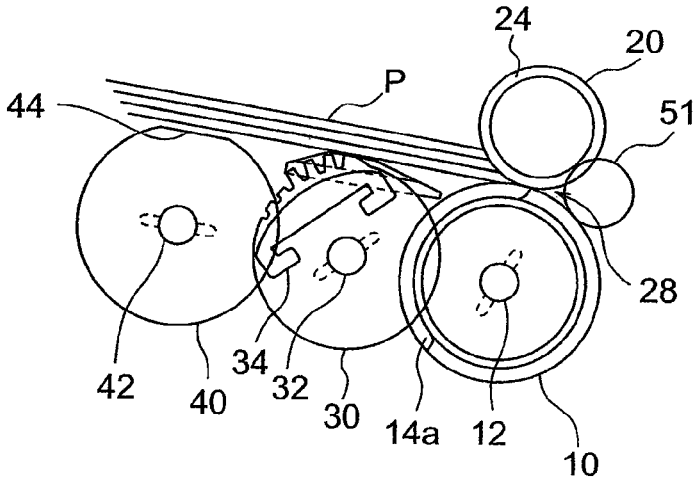
FIG. 3 is an explanatory view showing an operation of the paper-sheet feeding unit shown in FIG. 1 for feeding out paper sheets.
Figure 4:
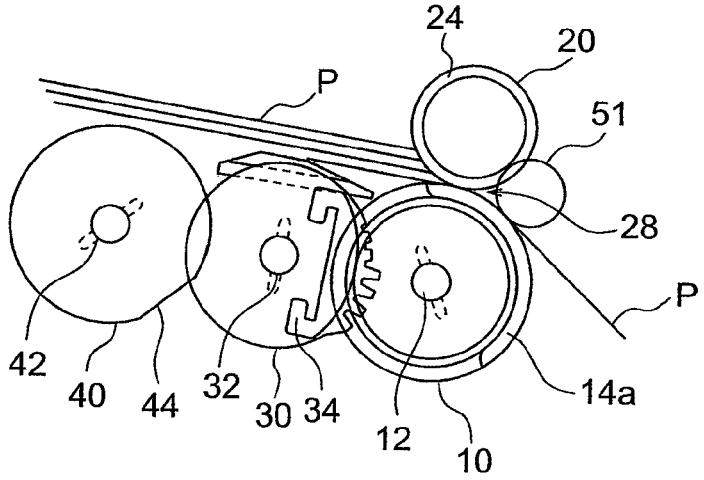
FIG. 4 is an explanatory view showing the operation of the paper-sheet feeding unit shown in FIG. 1 for feeding out the paper sheets, wherein a paper sheet is fed out by the feed roller from the state shown in FIG. 3.
Figure 5:
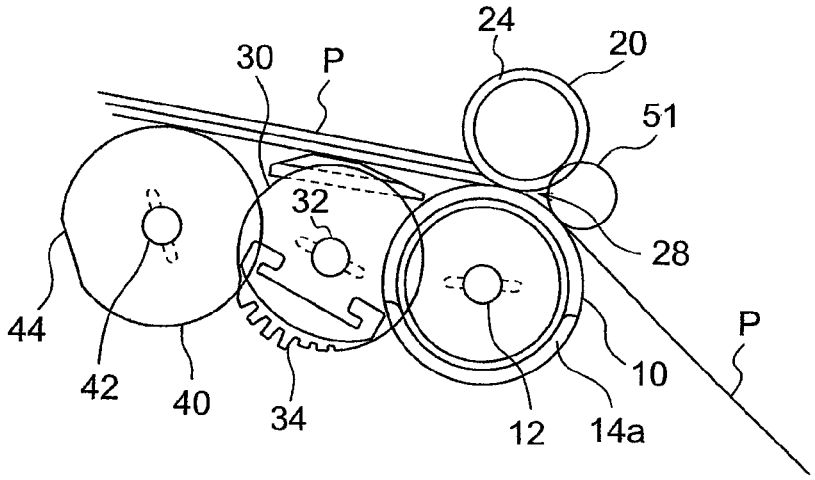
FIG. 5 is an explanatory view showing the operation of the paper-sheet feeding unit shown in FIG. 1 for feeding out the paper sheets, wherein the paper sheet is further fed out by the feed roller from the state shown in FIG. 4.
Figure 6A:
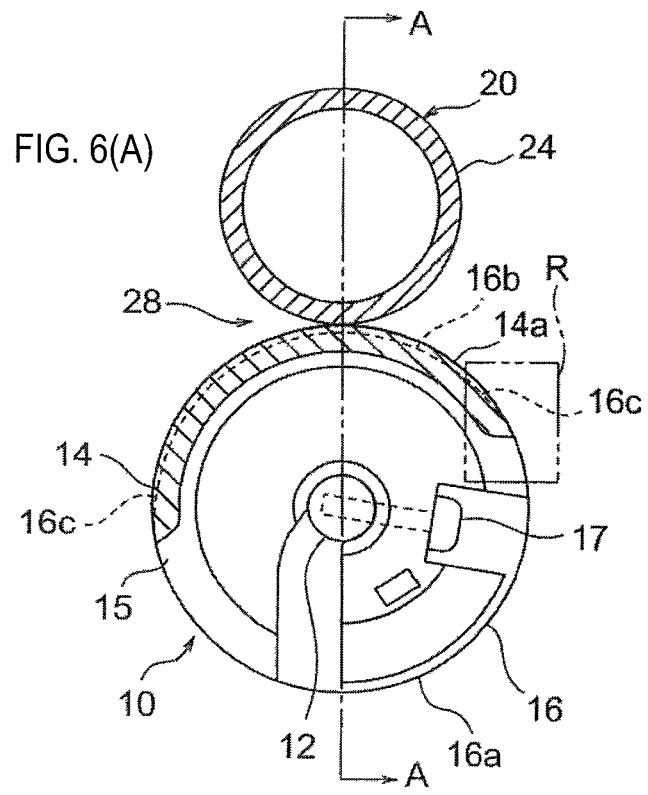
FIGS. 6(A), 6(B), 6(C), 6(D) and 6(E) are structural views showing the structure of the feed roller of the paper-sheet feeding unit shown in FIG. 1.
Figure 6B:
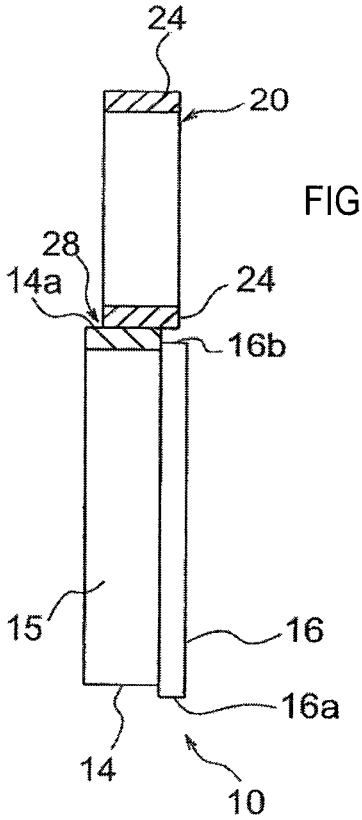
Figure 6C:
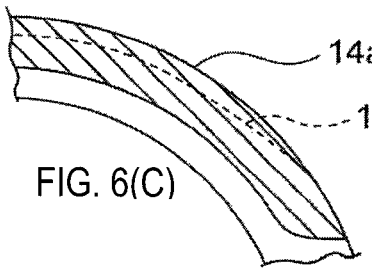
Figure 6D:
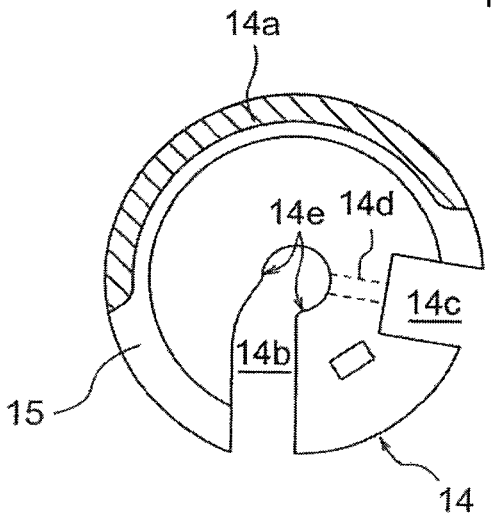
Figure 6E:
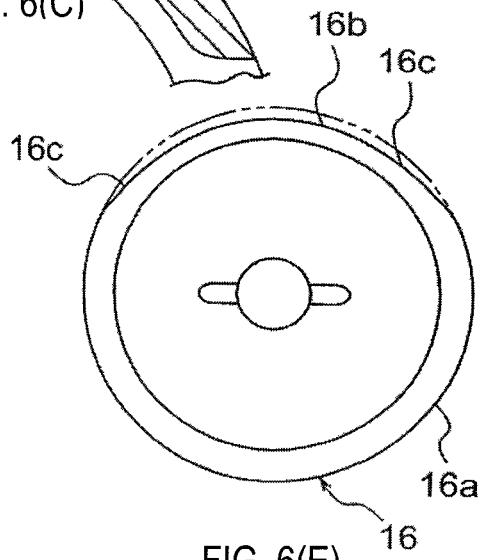
Figure 7:
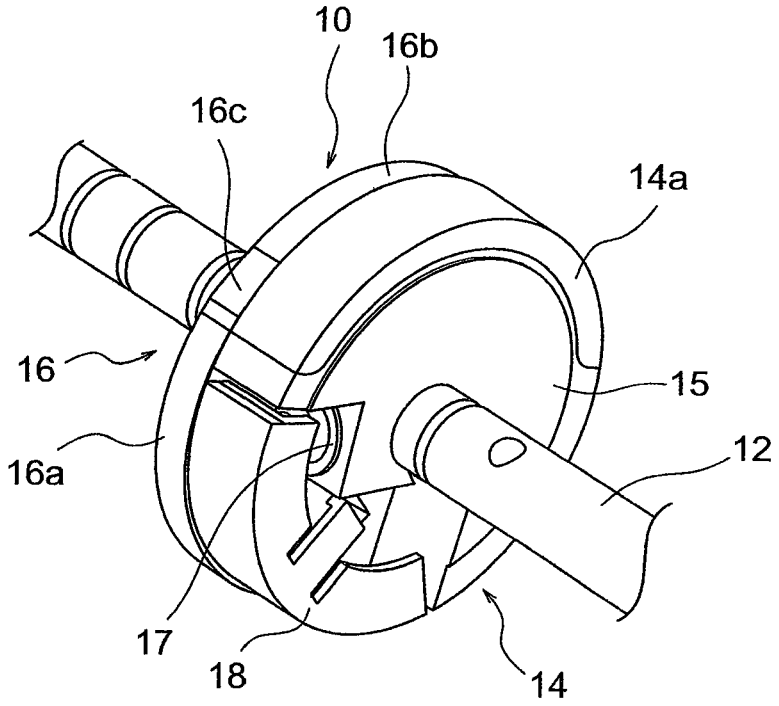
FIG. 7 is a perspective view showing the structure of the feed roller of the paper-sheet feeding unit shown in FIG. 1.
Figure 8:
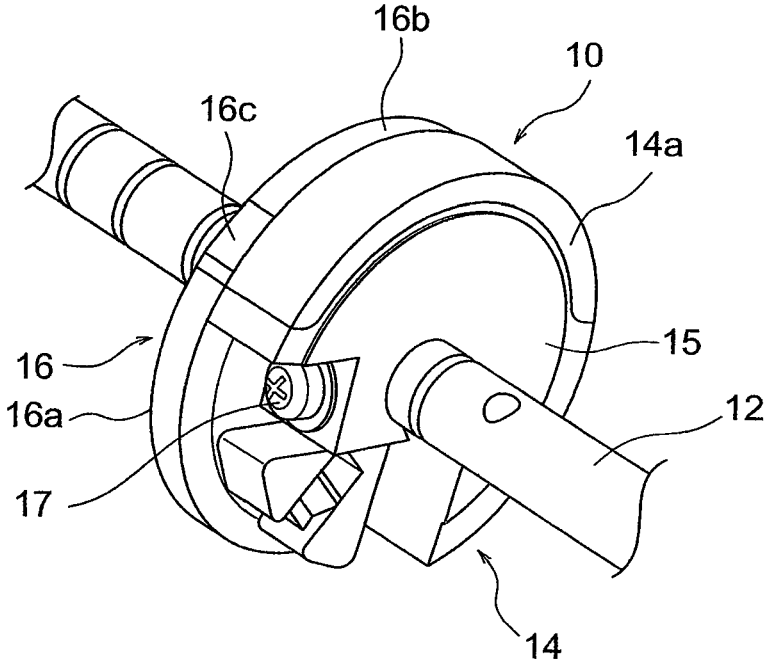
FIG. 8 is a perspective view showing the structure of the feed roller of the paper-sheet feeding unit shown in FIG. 1, wherein a cover member is detached from the state shown in FIG. 7.
Figure 9:
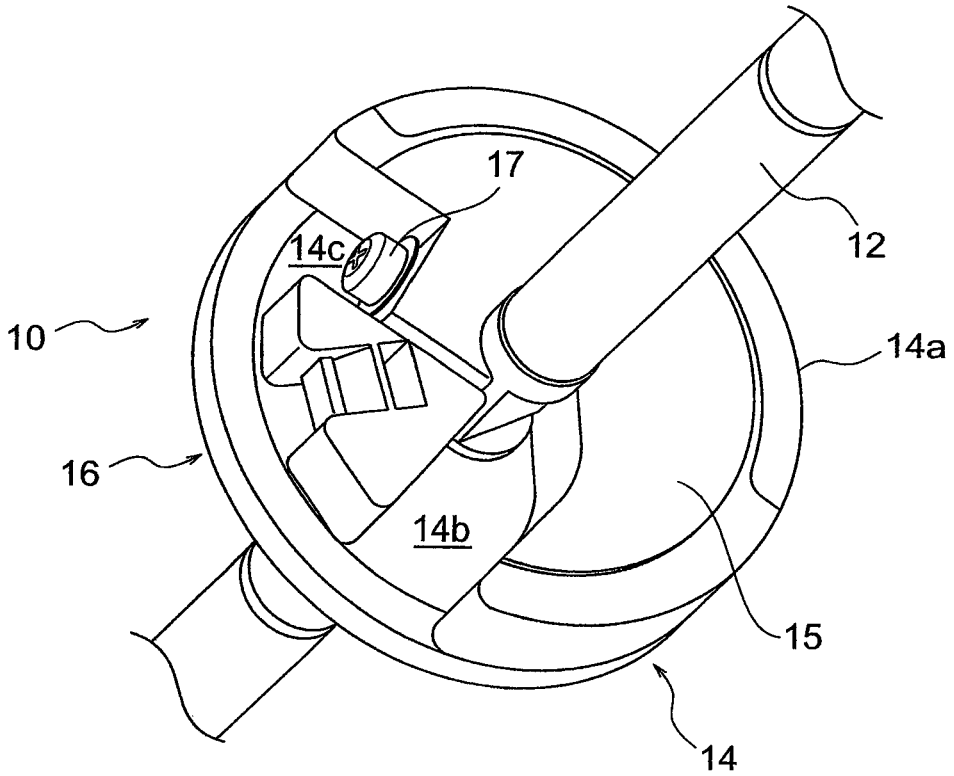
FIG. 9 is a perspective view showing the feed roller of the paper-sheet feeding unit shown in FIG. 1, when the feed roller is seen in another direction.

An embodiment of the present invention will be described therebelow with reference to the drawings. FIGS. 1 to 9 are views showing a structure of a paper-sheet feeding unit according to this embodiment. FIG. 1 is a schematic structural view showing the paper-sheet feeding unit in this embodiment. FIG. 2A is a plan view showing a positional relationship among rollers, when the paper-sheet feeding unit shown in FIG. 1 is seen from above. FIG. 2B is a view showing schematic structures of a feed roller and a delivery roller in the paper-sheet feeding unit shown in FIG. 2A. In FIG. 2A, a direction in which a paper sheet is fed out (feeding direction of a paper sheet) is indicated by an arrow P. FIGS. 3 to 5 are explanatory views showing an operation of the paper-sheet feeding unit shown in FIG. 1 for feeding out paper sheets. FIGS. 6(A), 6(B), 6(C), 6(D) and 6(E) are structural views showing the 20, structure of the feed roller of the paper-sheet feeding unit shown in FIG. 1. FIGS. 7 to 9 are perspective views showing the structure of the feed roller of the paper-sheet feeding unit shown in FIG. 1 when seen in different directions.

As shown in FIG. 1, the paper-sheet feeding unit 1 in this embodiment includes: a storing space 2 in which a plurality of paper sheets P are stored in a stacked state; a kicker roller 30 configured to kick out a lowermost paper sheet P among the plurality of paper sheets P in a stacked state in the storing space 2; a feed roller 10 configured to feed out the paper sheet P kicked out by the kicker roller 30; and a gate roller 20 arranged to be pressed against the feed roller 10 so as to form a gate section 28 between the gate roller 20 and the feed roller 10. In addition, in the storing space 2, a presser member 70 is disposed above the plurality of paper sheets P in a stacked state. The plurality of paper sheets P in a stacked state are pressed by the presser member 70 toward the kicker roller 30.

In addition, as shown in FIG. 1, the paper-sheet feeding unit 1 is provided with a pair of guide members 72 and 74. A paper sheet P fed out by the feed roller 10 is guided through a gap between the pair of guide members 72 and 74. Further, there are arranged, along the pair of guide members 72 and 74, a first transport roller 60, a first opposite roller 62 opposed to the first transport roller 60, a second transport roller 64 and a second opposite roller 66 opposed to the second transport roller 64. The paper sheet P guided along the pair of guide members 72 and 74 is transported through a gap between the first transport roller 60 and the first opposite roller 62, and thereafter transported through a gap between the second transport roller 64 and the second opposite roller 66. In addition, a paper-sheet detection sensor 68 is disposed between the first transport roller 60 and the second transport roller 64. Thus, the paper sheet P fed out from the paper-sheet feeding unit 1 is detected by the paper-sheet detection sensor 68.

The respective constituent elements of the paper-sheet feeding unit 1 are described in more detail below.

As shown in FIG. 1 and so on, the kicker roller 30 is located to be in contact with a surface of the lowermost paper sheet P among a plurality of paper sheets P in a stacked state in the storing space 2. When a feeding operation of paper sheets P is carried out, the kicker roller 30 is configured to be rotated about a shaft 32 in a direction shown by the arrow in FIG. 1. A rubber member 34 is placed on a part of a circumference of an outer circumferential surface of the kicker roller 30. A paper sheet P is kicked out by the rubber member 34 toward the gate section 28. As shown in FIG. 2A, the three kicker rollers 30, for example, are arranged in parallel along a width direction of a paper sheet P (up and down direction in FIG. 2A).

An auxiliary transport roller 40 is disposed on an upstream side of the kicker roller 30 in the feeding direction of a paper sheet P. When the feeding operation of paper sheets P is carried out, the auxiliary transport roller 40 is configured to be rotated about a shaft 42 in a direction shown by the arrow in FIG. 1. The auxiliary transport roller 40 is formed of a substantially discoid roller made of plastic or metal, for example. The auxiliary transport roller 40 is not provided with a rubber member. The auxiliary transport roller 40 has been subjected to a so-called "D cutting", so that a part of an outer circumferential surface of the auxiliary transport roller 40 in the circumferential direction is formed as a flat part 44. When a paper sheet P is kicked out by the kicker roller 30 toward the gate section 28, a paper sheet P to be kicked out is brought into contact with or brought close to the flat part 44 of the auxiliary transport roller 40. Thus, a frictional force applied by the kicker roller 30 to the paper sheet P to be kicked out can be increased, whereby the paper sheet P can be more reliably kicked out toward the gate section 28. As shown in FIG. 2A, the two auxiliary transport rollers 40, for example, are arranged in parallel along the width direction of the paper sheet P (up and down direction in FIG. 2A).

The structure of the feed roller 10 is described with reference to FIGS. 6(A), 6(B), 6(C), 6(D) and 6(E) to 9. FIGS. 6(A), 6(B), 6(C), 6(D) and 6(E) are structural views showing the structure of the feed roller of the paper-sheet feeding unit 1 shown in FIG. 1. In more detail, FIG. 6(A) is a view showing structures of the feed roller 10 and the gate roller 20 arranged to be pressed against the feed roller 10. FIG. 6(B) is a view taken along a line A-A of the feed roller 10 and the gate roller 20 shown in FIG. 6(A). FIG. 6(C) is an enlargement view of a part surrounded by two-dot chain lines in FIG. 6(A). FIG. 6(D) is a structural view showing a structure of a first feed roller part 14 of the feed roller 10 shown in FIG. 6(A) and so on. FIG. 6(C) is a structural view showing a structure of a second feed roller part 16 of the feed roller 10 shown in FIG. 6(A) and so on. FIG. 7 is a perspective view of the structure of the feed roller 10 of the paper-sheet feeding unit 1 shown in FIG. 1. FIG. 8 is a perspective view showing a state wherein a cover has been detached from the state shown in FIG. 7. FIG. 9 is a perspective view of the feed roller 10 of the paper-sheet feeding unit 1 shown in FIG. 1, when seen in another direction.

As shown in FIGS. 6(A), 6(B), 6(C), 6(D), and 6(E) to 9, the feed roller 10 includes the substantially discoid first feed roller part 14 and the substantially discoid second feed roller part 16. The first feed roller part 14 and the second feed roller part 16 are adjacently arranged (see FIG. 6(B)). The first feed roller part 14 and the second feed roller part 16 are concentric with each other. The first feed roller part 14 and the second feed roller part 16 are configured to be rotated integrally with each other about the shaft 12 in a direction shown by the arrow in FIG. 1. As described below, the first feed roller part 14 can be attached to or detached from the shaft 12, while the second feed roller part 16 is fixed on the shaft 12. More specifically, the first feed roller part 14 is removably attached to the shaft 12 by a screw 17.

A rubber member 14*a* (high friction portion) is formed on a part of a circumference of an outer circumferential surface of the first feed roller part 14. A paper sheet P having been delivered to the gate section 28 is fed out from the gate section 28 by the rubber member 14*a*. A part other than the rubber member 14*a* of the first feed roller part 14 functions as a support member 15 for supporting the rubber member 14*a*. The support member 15 is made of plastic or metal, for example. In this embodiment, the support member 15 serves as a low friction portion having a frictional coefficient smaller than that of the rubber member 14*a* (high friction portion). In addition, in this embodiment, the rubber member 14*a* and the support member 15 serve together as an attachment member for removably attaching the rubber member 14*a* to the shaft 12.

As shown in FIG. 6(D) and so on, the first feed roller part 14 is provided with a first cutout 14*b* (groove part) and a second cutout 14*c* (groove part). The first cutout 14*b* is formed to extend from a central portion of the first feed roller part 14 toward an outer circumferential surface thereof. While the first feed roller part 14 is being detached from the shaft 12, the first cutout 14*b* is used as a space through which the shaft 12 passes. On the other hand, when the first feed roller part 14 is fixed on the shaft 12 by the screw 17, the second cutout 14*c* is used as a space in which the screw 17 is accommodated. The first feed roller part 14 further has a screw hole 14*d* into which the screw 17 is inserted, when the first feed roller part 14 is fixed on the shaft 12 by the screw 17.

In the paper-sheet feeding unit 1 in this embodiment, the rubber member 14*a* of the first feed roller part 14 of the feed roller 10 can be attached to or detached from the shaft 12 in a direction perpendicular to a direction in which the shaft 12 extends. To be more specific, after the paper-sheet feeding unit 1 has been used for a long period of time so that the rubber member 14*a* of the first feed roper part 14 of the feed roller 10 has been worn away, the rubber member 14*a* should be exchanged. In this embodiment, when the rubber member 14*a* is exchanged, the screw 17 is detached to release the fixation of the first feed roller part 14 on the shaft 12, and then the rubber member 14*a* and the support member 15 are detached together from the shaft 12. Specifically, in a state shown in FIG. 9, by displacing a center of the support member 15 from the shaft 12, the shaft 12 can pass through the first cutout 14*b*. Thus, the first feed roller part 14 can be detached from the shaft 12. On the other hand, when the first feed roller part 14 provided with another rubber member 14*a* is attached to the shaft 12, the shaft 12 firstly passes through the first cutout 14*b* to be located on the center of the support member 15. Thereafter, by inserting the screw 17 into the screw hole 14*d*, the first feed roller part 14 is fixed on the shaft 12 by the screw 17.

As described above, in this embodiment, by moving the support member 15 in the direction perpendicular to the direction in which the shaft 12 extends, the first feed roller part 14 can be detached from the shaft 12 and can be attached to the shaft 12. In order that the first feed roller part 14 can be attached to the shaft 12 more accurately on a central position of the rotational shaft, it is preferable to cut out a part of an outer circumferential surface of a location of the shaft 12 to which the first feed roller part 14 is to be attached, so that the shaft 12 has a D-shaped section (i.e., a part of the outer circumferential surface of the shaft 12 in the circumferential direction has a flat part). Due to this structure, when the first feed roller part 14 is detached from the shaft 12 or attached to the shaft 12, when the shaft 12 is rotated such that the flat part of the shaft 12 fits in a space between edge parts 14*e* (see FIG. 6(D)) of the first cutout 14*b*, the first feed roller part 14 can be detached from the shaft 12 or attached to the shaft 12. Since a width of the space between the edge parts 14*e* of the first cutout 14*b* is smaller than the diameter of the shaft 12, only the portion having the smallest length in the D-shaped section of the shaft 12 is allowed to be passed through the space between the edge parts 14*e* of the first cutout 14*b*.

In addition, as shown in FIG. 7, the first feed roller part 14 is provided with a cover member 18 that can be attached to and detached from the support member 15. The first cutout 14*b* and the second cutout 14*c* of the first feed roller part 14 are covered with the cover member 18. Thus, when an operator conducts maintenance services on the feed roller 10, it can be prevented that the operator's finger or the like is caught into the first cutout 14*b* or the second cutout 14*c*, causing injuries. When the first feed roller part 14 is fixed on the shaft 12 by the screw 17 or when the first feed roller part 14 is detached from the shaft 12, as shown in FIG. 8, by detaching the cover member 18 from the support member 15, an operator can access the first cutout 14*b* and the second cutout 14*c*.

The second feed roller part 16 is formed of a substantially discoid member having a frictional coefficient smaller than that of the rubber member 14*a* of the first feed roller part 14. As shown in FIG. 6(C), the second feed roller part 16 is composed of a first outer circumferential part 16*a* that is an outer circumferential surface having relatively a large diameter length (a distance from the center of the feed roller 10), a second outer circumferential part 16*b* having a diameter length smaller than that of the first outer circumferential part 16*a* and two inclined parts 16*c* that are disposed between the first outer circumferential part 16*a* and the second outer circumferential part 16*b*. As shown in FIGS. 6(A), 6(B), 6(C), 6(D) and 6(E), the second outer circumferential part 16*b* of the second feed roller part 16 is located on a position corresponding to the rubber member 14*a* of the first feed roller part 14, and each of the two inclined parts 16*c* of the second feed roller part 16 is located on a position corresponding to an interface between the rubber member 14*a* of the first feed roller part 14 and the support member 15 thereof. Thus, in the second feed roller part 16, a distance between the inclined part 16*c* and the rotational center of the feed roller 10 gradually decreases from the support member 15 of the first feed roller part 14 toward the rubber member 14*a* thereof. Namely, the diameter length of the first outer circumferential part 16*a* of the second feed roller part 16 is substantially equal to or larger than the diameter length of the support member 15 of the first feed roller part 14. Meanwhile, the diameter length of the inclined part 16*c* of the second feed roller part 16 gradually decreases, and the diameter length of the second outer circumferential part 16*b* of the second feed roller part 16 is smaller than the diameter length of the rubber member 14*a* of the first feed roller part 14.

As shown in FIG. 6(B) and so on, in the feed roller 10, the diameter length (the distance from the center of the feed roller 10) of the first outer circumferential part 16*a* of the second feed roller part 16 is substantially equal to or larger than the diameter length of the support member 15 of the first feed roller part 14. On the other hand, the diameter length of each inclined part 16*c* of the second feed roller part 16 gradually decreases, and the diameter length of the second outer circumferential part 16*b* of the second feed roller part 16 is smaller than the diameter length of the rubber member 14*a* of the first feed roller part 14.

In addition, a length of the outer circumference of the feed roller 10 is larger than a maximum length of a paper sheet P to be fed out by the paper-sheet feeding unit 1 in the feeding direction of the paper sheet P. Meanwhile, a length of the rubber member 14*a* in the circumferential direction of the first feed roller part 14 of the feed roller 10 is smaller than a minimum length of a paper sheet P to be fed out by the paper-sheet feeding unit 1 in the feeding direction of the paper sheet P. As shown in FIG. 2A, the two feed rollers 10 are arranged in parallel along the width direction of the paper sheet P (up and down direction in FIG. 2A).

The gate roller 20 is arranged to be pressed against the feed roller 10. More specifically, the gate roller 20 is rotatably supported on a distal end of a gate-roller support arm 27. A proximal end of the gate-roller support arm 27 is pivotally supported by a shaft 27*a*. A torsion spring (not shown) is disposed on the shaft 27*a* of the gate-roller support arm 27, so that a force is applied by the torsion spring to the gate-roller support arm 27 in a direction shown by the arrow in FIG. 1. Thus, the gate roller 20 supported by the gate-roller support arm 27 is constantly subjected to a force toward the feed roller 10, whereby the gate roller 20 is pressed against the feed roller 10. In addition, as described above, the gate section 28 is formed between the gate roller 20 and the feed roller 10. Paper sheets P fed out by the feed roller 10 are separated, one by one, by the gate section 28.

The gate roller 20 has a shaft 22, and the gate roller 20 is rotatable about the shaft 22. As shown in FIG. 6(A) and so on, a rubber member 24 is formed all around an outer circumferential surface of the gate roller 20. The gate roller 20 is equipped with a one-way clutch 26. The gate roller 20 can be rotated by the one-way clutch 26 only in a direction (direction shown by the arrow in FIG. 1) reverse to the feeding direction of a paper sheet P. Thus, when the feed roller 10 is rotated in the direction reverse to the feeding direction of a paper sheet P, the gate roller 20 is rotated, along with the rotation of the feed roller 10, in the direction reverse to the feeding direction of a paper sheet P. Meanwhile, when a paper sheet P is fed out, the gate roller 20 is not rotated in the feeding direction of a paper sheet P because of the provision of the one-way clutch 26. As shown in FIG. 2A, the two gate rollers 20, for example, are arranged in parallel to be opposed to the feed rollers 10 along the width direction of a paper sheet P (up and down direction in FIG. 2A).

As shown in FIG. 2A, delivery rollers 50 are arranged on both lateral sides of each feed roller 10. Namely, the four delivery rollers 50 in total are disposed in the paper-sheet feeding unit 1 in this embodiment. In FIG. 1, illustration of the delivery rollers 50 is omitted. A size of an external diameter of each delivery roller 50 is substantially the same as a size of an external diameter of each feed roller 10. In addition, correspondingly to each delivery roller 50, a pinch roller 51 is arranged to be pressed against an outer circumferential surface of each delivery roller 50. Each pinch roller 51 is formed of a bearing or the like and is rotatable. The pinch roller 51 is configured to be rotated along with the rotation of the corresponding delivery roller 50.

As shown in FIG. 2B, a rubber member 52 (high frictional section) is placed on a part of a circumference of an outer circumferential surface of each delivery roller 50. A part other than the rubber member 52 in the outer circumferential surface functions as a base body 54 (low frictional part) made of plastic or metal. A length of the rubber member 52 in the circumferential direction of each delivery roller 50 is larger than a length of the rubber member 14*a* in the circumferential direction of the first feed roller part 14 of the feed roller 10. Thus, after a paper sheet P has been fed out by the rubber member 14*a* of the first feed roller part 14 of the feed roller 10, the paper sheet P can be fed out by the rubber member 52 of the delivery roller 50 to a position between the first transport roller 60 and the first opposite roller 62. Namely, after having been fed out, the paper sheet P can be reliably transported.

Next, an operation of the paper-sheet feeding unit 1 as structured above, specifically a feeding method of a paper sheet P by the paper-sheet feeding unit 1, is described with reference to FIGS. 3 to 5.

As shown in FIG. 1 and so on, when a plurality of paper sheets P are stored in the storing space 2 in a stacked state, the lowermost paper sheet P is kicked out by the kicker roller 30. To be specific, as shown in FIG. 3, the lowermost paper sheet P is kicked out by the rubber member 34 provided on the kicker roller 30 toward the gate section 28. When the kicker roller 30 kicks out the paper sheet P toward the gate section 28, the paper sheet P to be kicked out is brought into contact with or brought close to the flat part 44 of the auxiliary transport roller 40. Thus, a frictional force applied by the kicker roller 30 to the paper sheet P to be kicked out can be increased, so that the paper sheet P can be more reliably kicked out toward the gate section 28. In addition, as shown in FIG. 3, when the rubber member 14*a* of the first feed roller part 14 of the feed roller 10 is opposed to the gate roller 20, the kicker roller 30 is configured to kick out the paper sheet P toward the gate section 28. Thus, the paper sheet P having been delivered to the gate section 28 can be promptly fed out by the feed roller 10, and wear of the rubber member 24 of the gate roller 20 can be restrained.

As shown in FIG. 4, the paper sheet P having been delivered to the gate section 28 is fed out, one by one, by the rubber member 14*a* of the first feed roller part 14 of the feed roller 10. At this time, the gate roller 20 is maintained to stop. Then, as shown in FIG. 5, after the paper sheet P has been completely fed out by the feed roller 10 and a predetermined period of time has elapsed, a succeeding paper sheet p is kicked out by the kicker roller 30 toward the gate section 28.

In this embodiment, since the rubber member 14*a* is placed on a part of the circumference of the outer circumferential surface of the first feed roller part 14 of the feed roller 10, instead of being placed all around the same, installation of a torque limiter on the gate roller 20 can be omitted. That is to say, suppose that the rubber member 14*a* is placed all around the outer circumferential surface of the first feed roller part 14 of the feed roller 10. In this case, unless a torque limiter is disposed on the gate roller 20, the gate roller 20 is not rotated along with the rotation of the feed roller 10 but is stopped, although the feed roller 10 is rotated when no paper sheet P exists in the gate section 28. Thus, there occurs a problem that a certain point in the rubber member 24 of the gate roller 20 is intensively worn away. On the other hand, in this embodiment, the rubber member 14*a* is placed on a part of the circumference of the outer circumferential surface of the first feed roller part 14 of the feed roller 10. In this case, in the feeding operation of a paper sheet P, when the rubber member 14*a* of the first feed roller part 14 of the feed roller 10 and the rubber member 24 of the gate roller 20 are opposed to each other, a paper sheet P to be fed out by the feed roller 10 exists between the rubber members 14*a* and 24. Thus, direct contact between the rubber members 14*a* and 24 can be prevented as much as possible. Therefore, the wear of the rubber member 24 of the gate roller 20 can be restrained, without installation of a torque limiter on the gate roller 20.

In addition, in this embodiment, as described above, the length of the outer circumference of the feed roller 10 is larger than the maximum length of a paper sheet P to be fed out by the paper-sheet feeding unit 1 in the feeding direction of the paper sheet P. Simultaneously, the length of the rubber member 14*a* in the circumferential direction of the first feed roller part 14 of the feed roller 10 is smaller than the minimum length of a paper sheet P to be fed out by the paper-sheet feeding unit 1 in the feeding direction of the paper sheet P. Thus, there can be prevented that two or more paper sheets P are fed out at once in a chained state or in an overlapped state by the rubber member 14*a*.

In addition, when the paper-sheet feeding unit 1 is used for a long period of time, the rubber member 14*a* of the first feed roller part 14 of the feed roller 10 is worn away. When the rubber member 14*a* is worn away so that the diameter length thereof (distance from the center of the feed roller 10) becomes smaller than the diameter length of the second outer circumferential part 16*b* of the second feed roller part 16 and/or the diameter length of the inclined parts 16*c* thereof, the gate section 28 is formed between the second feed roller part 16 and the gate roller 20. As described above, since the distance between the inclined part 16*c* and the rotational center of the feed roller 10 gradually decreases from the support member 15 of the first feed roller part 14 toward the rubber member 14*a* thereof, the gate roller 20 is smoothly pressed against the feed roller 10, so as to prevent the gate roller 20 from bounding. In other words, unless there is the second feed roller part 16, when the rubber member 14*a* of the first feed roller part 14 is worn away, a step is formed between the rubber member 14*a* of the first feed roller part 14 and the outer circumference of the support member 15 thereof. Because of the step, the gate roller 20 may bound against the feed roller 10, resulting in adverse affect on the feeding performance of a paper sheet P. However, due to the provision of the second feed roller part 16, even when the rubber member 14*a* of the first feed roller part 14 is worn away so that a step is formed between the rubber member 14*a* of the first feed roller part 14 and the outer circumference of the support member 15 thereof, the inclined parts 16*c* of the second feed roller part 16 compensate for such a step. Therefore, there is no possibility that the gate roller 20 bounds against the feed roller 10.

In addition, in this embodiment, when the paper-sheet feeding unit 1 is in a standby condition after the feeding operation of a paper sheet P by the paper-sheet feeding unit 1 has been finished, when the feed roller 10 is rotated in the direction reverse to the feeding direction of a paper sheet P, the gate roller 20 is rotated, along with the rotation of the feed roller 10, in the direction reverse to the feeding direction of a paper sheet P. Owing to this operation, a location of the gate roller 20, at which the gate roller 20 is in contact with the feed roller 10, can be changed. Thus, it can be prevented that a certain point in the rubber member 24 of the gate roller 20 is intensively worn away (uneven wear).

As described above, according to the paper-sheet feeding unit 1 in this embodiment, in the feed roller 10, the rubber member 14*a* is placed on a part of the circumference of the outer circumferential surface of the first feed roller part 14, and the part other than the rubber member 14*a* of the outer circumferential surface of the feed roller 10 is provided with the support member 15, which has a frictional coefficient smaller than that of the rubber member 14*a*, and the first outer circumferential part 16*a* of the second feed roller part 16. In addition, the gate roller 20 is arranged to be pressed against the outer circumferential surface of the feed roller 10. Since the rubber member 14*a* is placed on a part of the circumference of the outer circumferential surface of the feed roller 10, instead of being placed all around the outer circumferential surface of the feed roller 10, installation of a torque limiter on the gate roller 20 can be omitted. Thus, reduction in cost and size can be achieved. Moreover, since the gate roller 20 is arranged to be pressed against the outer circumferential surface of the feed roller 10, plural kinds of paper sheets having different thicknesses and/or stiffnesses can be properly fed out.

In addition, according to the paper-sheet feeding unit 1 in this embodiment, the second feed roller part 16 of the feed roller 10 has the inclined parts 16*c* each of which is located at a position near the interface between the rubber member 14*a* (high friction portion) of the first feed roller part 14 and the support member 15 (low friction portion) thereof. The distance between the inclined part 16*c* and the rotational center of the feed roller 10 gradually decreases from the support member 15 toward the rubber member 14*a*. Thus, even after the paper-sheet feeding unit 1 has been used for a long period of time so that the rubber member 14*a* of the first feed roller part 14 has been worn away, the gate roller 20 can be prevented from bounding against the feed roller 10.

In addition, according to the paper-sheet feeding unit 1 in this embodiment, the rubber member 14*a* of the first feed roller part 14 of the feed roller 10 can be attached to or detached from the shaft 12 of the feed roller 10 in the direction perpendicular to the direction in which the shaft 12 extends. Thus, even after the paper-sheet feeding unit 1 has been used for a long period of time so that the rubber member 14*a* of the first feed roller part 14 has been worn away, the rubber member 14*a* can be easily exchanged. Namely, when the rubber member disposed on the outer circumferential surface of the feed roller is worn away, it has been conventionally needed to detach the feed roller itself from the rotational shaft by moving the feed roller in the axial direction of the rotational shaft, and then to attach to the rotational shaft the feed roller to which a new rubber member has been attached. On the other hand, in this embodiment, the rubber member 14*a* can be exchanged without detaching the feed roller 10 itself from the shaft 12 by moving the feed roller 10 in the direction in which the shaft 12 extends. Thus, it is easy to conduct maintenance services on the rubber 14*a* (high friction portion) and reduction in maintenance cost can be achieved.

The paper-sheet feeding unit in this embodiment is not limited to the above embodiment, but can be variously modified.

For example, in the paper-sheet feeding unit 1 shown in FIG. 1 and so on, the gate section 28 is formed by pressing the gate roller 20 against the feed roller 10, and paper sheets P, which are fed out by the feed roller 10, are separated, one by one, by the gate section 28. However, a gate member for forming the gate section is not limited to the gate roller 20. A structure other than a roller, specifically, e.g., a pad may be used as the gate member for forming the gate section.

In addition, the feed roller 10 is not limited to the split-type roller as shown in FIGS. 6(A), 6(B), 6(C), 6(D) and 6(E), which are composed of the first feed roller part 14 and the second feed roller part 16. An integral-type roller may be used as the feed roller. In a case where an integral-type roller is used as the feed roller, when a rubber member disposed on the outer circumferential surface of the feed roller is worn away, the feed roller is detached from the rotational shaft by moving the feed roller itself in the axial direction of the rotational shaft, and then the feed roller to which a new rubber member has been attached is attached to the rotational shaft.

In a case where the feed roller 10 is of a split-type, the feed roller 10 is not limited to a roller in which the rubber member 14*a* can be attached to or detached from the shaft 12 of the feed roller 10 in the direction perpendicular to the direction in which the shaft 12 extends. The feed roller may be a roller in which the rubber member (high friction portion) can be attached to or detached from the base body of the feed roller fixed on the rotational shaft in the direction in which the rotational shaft extends.

Herebelow, various structural examples of the split-type feed roller will be described with reference to FIGS. 10 to 13. FIGS. 10 to 13 are perspective views respectively showing other structures of the feed roller of the paper-sheet feeding unit 1 in this embodiment.

Figure 10:
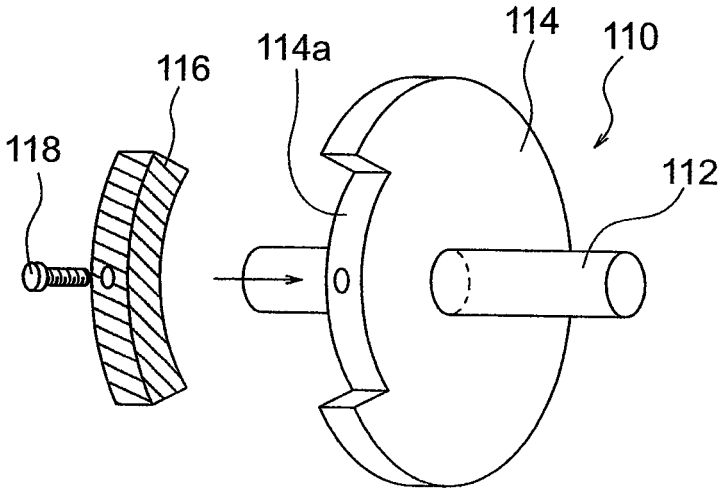
FIG. 10 is a perspective view showing another structure of the feed roller of the paper-sheet feeding unit in this embodiment.

In a feed roller 110 shown in FIG. 10, a substantially discoid base body 141 made of plastic or metal is disposed on a shaft 112. The base body 114 has a cutout 114*a* in which a rubber member 116 can be fitted. The rubber member 116 can be attached to the cutout 114*a* of the base body 114 by a screw 118 or the like. Namely, in the feed roller 110 shown in FIG. 10, the rubber member 116 (high friction portion) can be attached to or detached from the base body 114 of the feed roller 110 fixed on the shaft 112 in the direction perpendicular to the direction in which the shaft 112 extends.

Figure 11:
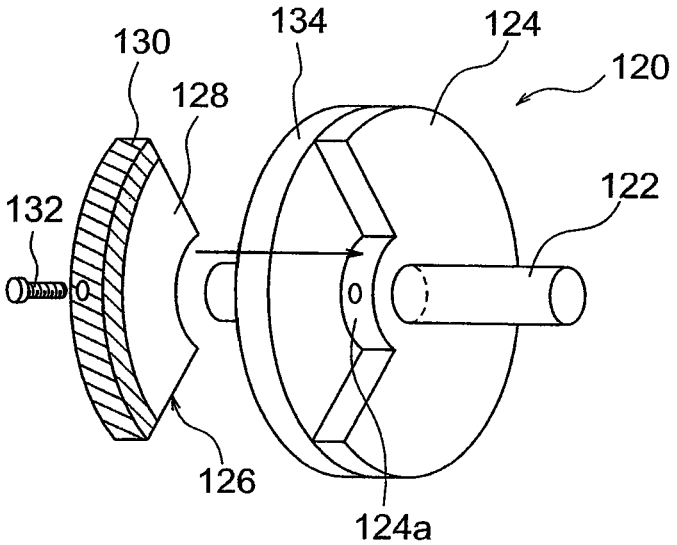
FIG. 11 is a perspective view showing still another structure of the feed roller of the paper-sheet feeding unit in this embodiment.

In a feed roller 120 shown in FIG. 11, a substantially discoid base body 124 made of plastic or metal is disposed on a shaft 122. An additional disc 134 of the same structure as that of the second feed roller part 16 shown in FIGS. 6(A), 6(B), 6(C), 6(D) and 6(E) are joined to the first base body 124. In addition, the base body 124 has a cutout 124*a* in which an attachment member 126 can be fitted. The attachment member 126 is composed of a rubber member 130 and a support member 128 that supports the rubber member 130. The attachment member 126 can be attached to the cutout 124*a* of the base body 124 by a screw 132 or the like. Namely, in the feed roller 120 shown in FIG. 11, the rubber member 130 (high friction portion) can be attached to or detached from the base body 124 of the feed roller 120 fixed on the shaft 122 in the direction perpendicular to the direction in which the shaft 122 extends.

Figure 12:
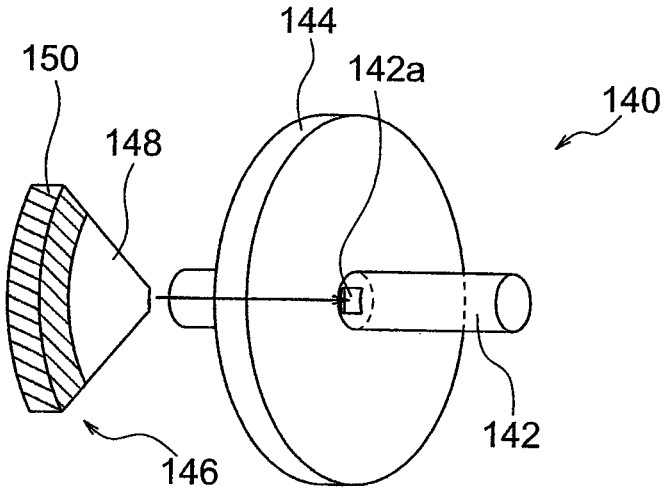
FIG. 12 is a perspective view showing still another structure of the feed roller of the paper-sheet feeding unit in this embodiment.

In a feed roller 140 shown in FIG. 12, an attachment member 146, which is composed of a rubber member 150 and a support member 148 that supports the rubber member 150, can be directly attached to a shaft 142. More specifically, the shaft 142 has a cutout 142*a* in which the attachment member 146 can be fitted, so that the attachment member 146 can be attached to the cutout 142*a* of the shaft 142. In addition, the shaft 142 is provided with an additional disc 144 of the same structure as that of the second feed roller part 16 shown in FIGS. 6(A), 6(B), 6(C), 6(D) and 6(E). Namely, in the feed roller 140 shown in FIG. 12, the rubber member 150 (high friction portion) can be attached to or detached from the shaft 142 in the direction perpendicular to the direction in which the shaft 142 extends.

Figure 13:
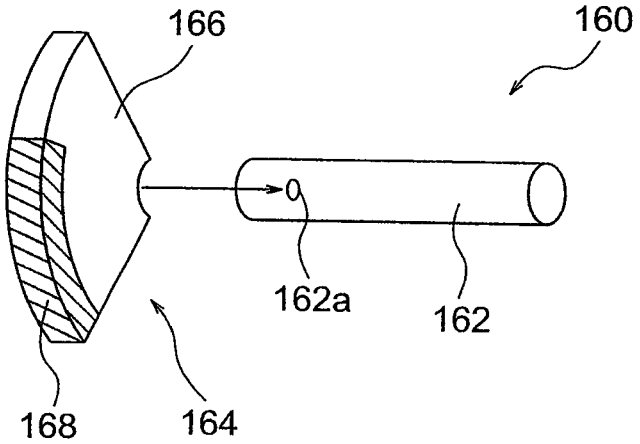
FIG. 13 is a perspective view showing still another structure of the feed roller of the paper-sheet feeding unit in this embodiment.
Figure 14A:
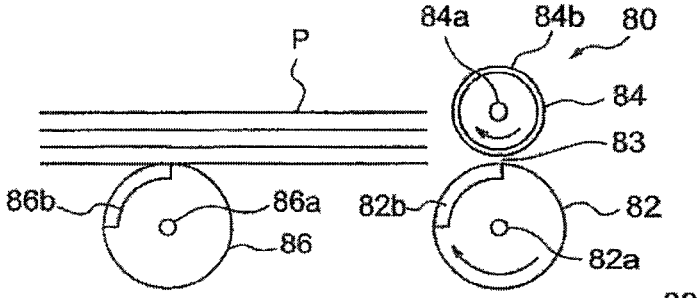
FIG. 14(A) Prior Art
FIGS. 14(A) and 14(B) are schematic structural views schematically showing a structure of a conventional paper-sheet feeding unit.
Figure 14B:
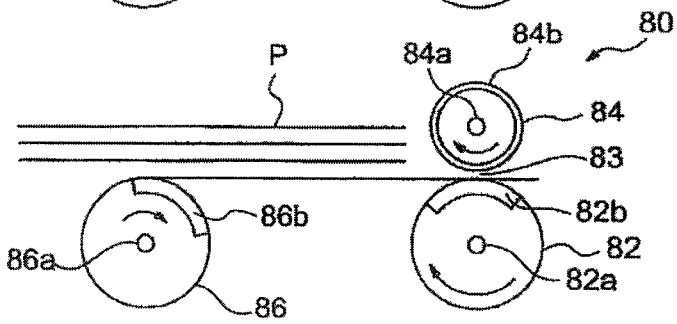
FIG. 14(B) Prior Art
Figure 15A:
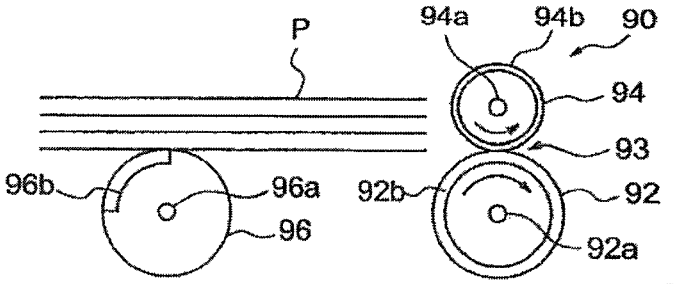
FIG. 15(A) Prior Art
FIGS. 15(A) and 15(B) are schematic structural views schematically showing another structure of a conventional paper-sheet feeding unit.
Figure 15B:
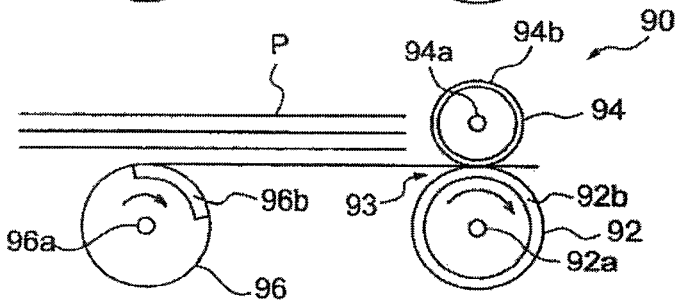
FIG. 15(B) Prior Art

Also in a feed roller 160 shown in FIG. 13, an attachment member 164, which is composed of a rubber member 168 and a support member 166 that supports the rubber member 168, can be directly attached to a shaft 162. More specifically, the shaft 162 has a screw hole 162*a*, so that the attachment member 164 can be attached to the position of the screw hole 162*a* by a screw, not shown. Namely, in the feed roller 160 shown in FIG. 13, the rubber member 168 (high friction portion) can be attached to or detached from the shaft 162 in the direction perpendicular to the direction in which the shaft 162 extends.

As described above, in the respective feed rollers 110, 120, 140 and 160 shown in FIGS. 10 to 13, the rubber member of the feed roller can be attached to or detached from the shaft of the feed roller or the base body provided on the shaft, in the direction perpendicular to the direction in which the shaft extends. Thus, even after the paper-sheet feeding unit 1 has been used for a long period of time so that the rubber member of the feed roller has been worn away, the rubber member can be exchanged without detaching the feed roller itself from the shaft by moving the feed roller in the direction in which the shaft extends. Therefore, it is easy to conduct maintenance services on the rubber member (high friction portion), and reduction in maintenance cost can be achieved.

What is claimed is:

1. A paper-sheet feeding unit configured to feed out, one by one, paper sheets in a stacked state, the paper-sheet feeding unit comprising:

a feed roller configured to be rotated when feeding out the paper sheet, the feed roller having a high friction portion placed on a part of a circumference of an outer circumferential surface thereof, and a low friction portion placed on a location of the outer circumferential surface thereof other than the high friction portion, the low friction portion having a frictional coefficient smaller than that of the high friction portion; and a gate member arranged to be pressed against the outer circumferential surface of the feed roller, the gate member constituting a gate section configured to separate, one by one, the paper sheets fed out by the feed roller, the gate member having a gate roller configured to be contacted with the paper sheet and configured not to be rotated either in a direction in which the paper sheet is fed out or in a direction reverse to the direction in which the paper sheet is fed out, when feeding out the paper sheet, wherein the gate roller has a friction portion on an outer circumferential surface thereof, and the gate member includes a one-way clutch disposed on the gate roller, the gate roller is configured to be rotated by the one-way clutch only in a direction reverse to a direction in which the paper sheet is fed out, and when the feed roller is rotated in the direction reverse to the direction in which the paper sheet is fed out, the gate roller is configured to be rotated, along with the rotation of the feed roller, in the direction reverse to the direction in which the paper sheet is fed out.

2. The paper-sheet feeding unit according to claim 1, wherein a length of an outer circumference of the feed roller is larger than a length of the paper sheet to be fed out by the paper-sheet feeding unit, in a direction in which the paper sheet is fed out.

3. The paper-sheet feeding unit according to claim 1, wherein a length of the high friction portion in a circumferential direction of the feed roller is smaller than a minimum length of the paper sheet to be fed out by the paper-sheet feeding unit, in a direction in which the paper sheet is fed out.

4. The paper-sheet feeding unit according to claim 1, further comprising a delivery mechanism disposed on an upstream side of the feed roller in the direction in which the paper sheet is fed out, the delivery mechanism being configured to be brought into contact with a surface of the foremost paper sheet among the plurality of paper sheets in a stacked state so as to deliver the paper sheet to the gate section, wherein the delivery mechanism is configured to deliver the paper sheet to the gate section, when the high friction portion of the feed roller is opposed to the gate member.

5. The paper-sheet feeding unit according to claim 1, wherein a position of a rotational center of the gate roller is higher than a position of a rotational center of the feed roller.

6. The paper-sheet feeding unit according to claim 1, wherein a rotational center of the gate roller is located above a rotational center of the feed roller.

7. A paper-sheet feeding unit configured to feed out, one by one, paper sheets in a stacked state, the paper-sheet feeding unit comprising:

a feed roller configured to be rotated when feeding out the paper sheet, the feed roller having a high friction portion placed on a part of a circumference of an outer circumferential surface thereof, and a low friction portion placed on a location of the outer circumferential surface thereof other than the high friction portion, the low friction portion having a frictional coefficient smaller than that of the high friction portion; and a gate member arranged to be pressed against the outer circumferential surface of the feed roller, the gate member constituting a gate section configured to separate, one by one, the paper sheets fed out by the feed roller, the gate member having a gate roller configured to be contacted with the paper sheet and configured not to be rotated either in a direction in which the paper sheet is fed out or in a direction reverse to the direction in which the paper sheet is fed out, when feeding out the paper sheet, wherein:

there are provided a delivery roller having an external diameter substantially the same as an external diameter of the feed roller on a lateral side of the feed roller, and a pinch roller configured to be rotated while being pressed against an outer circumferential surface of the delivery roller; and the delivery roller is configured to be rotated when feeding out the paper sheet, the delivery roller having a high friction portion placed on a part of a circumference of an outer circumferential surface thereof, and a low friction portion placed on a location of the outer circumferential surface thereof other than the high friction portion, the low friction portion having a frictional coefficient smaller than that of the high friction portion.

8. The paper-sheet feeding unit according to claim 7, wherein a length of the high friction portion in a circumferential direction of the delivery roller is larger than a length of the high friction portion in a circumferential direction of the feed roller.

9. The paper-sheet feeding unit according to claim 7, wherein a position of a rotational center of the gate roller is higher than a position of a rotational center of the feed roller.

10. The paper-sheet feeding unit according to claim 7, wherein a rotational center of the gate roller is located above a rotational center of the feed roller.

* * * * *